United States Patent [19]

Beckner

[11] 3,945,150

[45] Mar. 23, 1976

[54] RUNNERHEAD FOR A THROWING WHEEL

[75] Inventor: Wilbur Ripple Beckner, Waynesboro, Pa.

[73] Assignee: The Carborundum Company, Niagara Falls, N.Y.

[22] Filed: Jan. 20, 1975

[21] Appl. No.: 542,327

[52] U.S. Cl. ..... 51/9 R; 241/275

[51] Int. Cl.[2] ..... B24C 5/06

[58] Field of Search ..... 51/9 R; 241/275, 300

[56] References Cited

UNITED STATES PATENTS

| | | | |
|---|---|---|---|
| 2,119,812 | 6/1938 | Hamren | 51/9 R |
| 2,869,289 | 1/1959 | Gossard | 51/9 R |
| 3,241,266 | 3/1966 | Bowling | 51/9 R |
| 3,383,804 | 5/1968 | Haider | 51/9 R |

*Primary Examiner*—Al Lawrence Smith
*Assistant Examiner*—Nicholas P. Godici
*Attorney, Agent, or Firm*—David E. Dougherty; William H. Holt

[57] ABSTRACT

A runnerhead for a throwing wheel of the type used in blast cleaning and peening operations includes a throwing vane receiving channel provided with a locking pin hole and a locking pin for locking a throwing vane in the channel and a locking pin release channel is formed in the runnerhead contiguous with the locking pin hole for allowing the locking pin to be tilted out of the locking pin hole.

4 Claims, 5 Drawing Figures

RUNNERHEAD FOR A THROWING WHEEL

BACKGROUND OF THE INVENTION

The present invention relates to throwing wheels of the type used for abrasive blast cleaning or peening wherein a throwing wheel includes a plurality of throwing vanes mounted upon a runnerhead in a vane receiving channel. Such throwing vanes must be locked in the runnerhead against the action of centrifugal force during high speed rotation. More particularly, the invention relates to a unique improvement of the vane locking apparatus shown in FIGS. 23–30 in U.S. Pat. No. 3,241,266 which was granted to Joseph E. Bowling, Jr., on Mar. 22, 1966.

The vane locking mechanisms of the prior art, as exemplified by U.S. Pat. No. 3,241,266 properly perform the function of locking the throwing vanes in the runnerhead. However, a very serious disadvantage of the prior art is inherent in the fact that particles of grit, abrasive throwing media and the like cause the locking pins to jam in the locking pin hole and creates a serious problem during maintenance of the throwing wheel. As is well known, the throwing vanes are subjected to highly abrasive actions during operation and it becomes necessary to replace the throwing vanes either weekly, daily or sometimes hourly. There have been occasions when the locking pins have become so jammed that it takes five to seven minutes of frustrating effort to remove the locking pin so that a worn out throwing vane can be replaced.

SUMMARY OF THE INVENTION

The present invention provides a runnerhead for a throwing wheel wherein the runnerhead comprises a plate member having a face and at least one vane receiving channel formed in the face for receiving a throwing vane, and a locking means is provided for locking the throwing vane in the vane receiving channel, the locking means including a locking pin hole for receiving a locking pin, the hole being formed in the plate member and extending angularly inwardly from the face. The improvement is comprised of providing a locking pin release channel formed in the plate member contiguous with the locking pin hole.

More particularly, the locking pin release channel and the locking pin hole have respective axial center lines disposed parallel to each other and the locking pin release channel spans the locking pin hole for allowing a locking pin to be tilted from the locking pin hole in a plane perpendicular to the vane receiving channel. As a result, maintenance procedures which heretofore required five to seven minutes can be promptly performed in a matter of a few seconds, or less.

DETAILED DESCRIPTION OF THE INVENTION

A portion of a throwing wheel, generally indicated by the numeral 10 includes a runnerhead 12 which is provided with a series of throwing vanes 14. The throwing vanes 14 are shown as being radially disposed on the runnerhead 12 but it is to be understood that such throwing vanes may be of different configurations and be disposed on the runnerhead other than radially.

Figure 1:
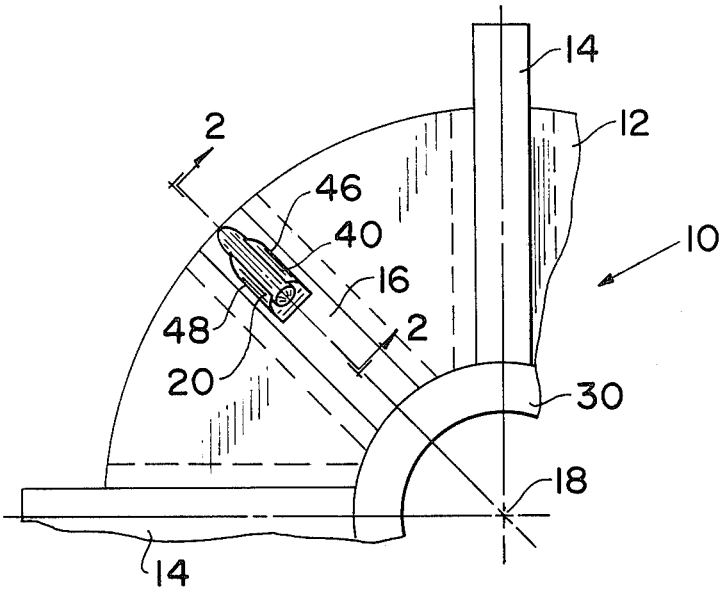
FIG. 1 is a fragmentary plan view of a portion of a throwing wheel and a vane locking pin hole provided with a locking pin release channel according to the present invention.
Figure 2:
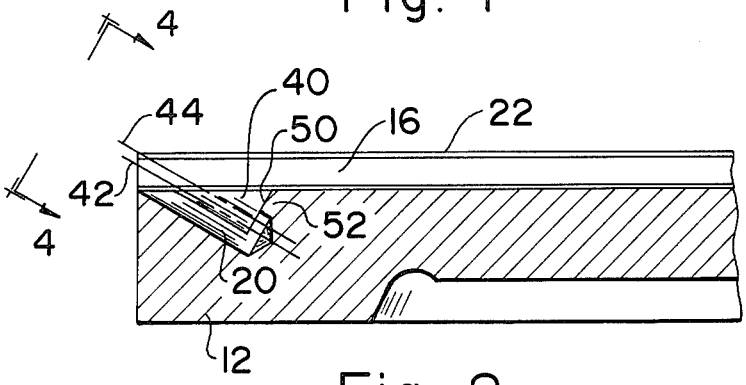
FIG. 2 is a sectional view, taken on line 2—2 of FIG. 1, and illustrates the parallel relationship of the axial center lines of the locking pin hole and the locking pin release channel.
Figure 4:
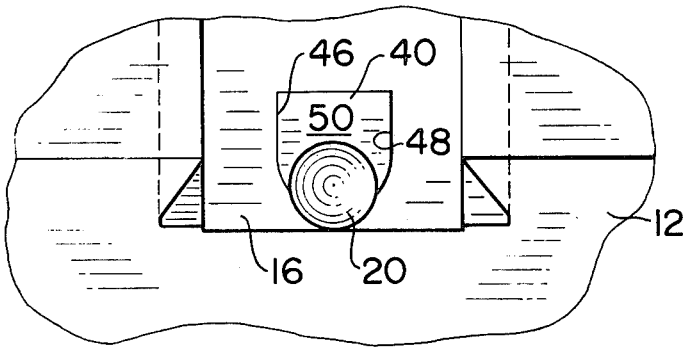
FIG. 4 is a fragmentary edge view taken on line 4—4 of FIG. 2.

As is best shown in FIGS. 1, 2 and 4, the runnerhead 12 is provided with a series of conventional dove-tailed vane receiving channels 16 such that the throwing vanes 14 can be slid radially inwardly of the runnerhead 12 in a manner well known in the prior art as exemplified by U.S. Pat. No. 3,241,266. During operation of the throwing wheel 10 the runnerhead 12 is rotated about a central axis indicated by the numeral 18 in FIG. 1. In order to keep the throwing vanes 14 in proper location and to preclude movement of the throwing vanes out of the vane receiving channels 16 because of centrifugal force, each vane receiving channel 16 is provided with a locking pin hole 20 which is, preferably, bored or drilled into the runnerhead 12 along the vane receiving channel 16 and tapers downwardly and inwardly at an angle which may be approximately 30° to a top face 22 of the runnerhead 12. As is shown, the locking pin hole is cylindrical for receiving a cylindrical locking pin 24; however, it is to be understood that the locking pin 24 may have other configurations such as being square, triangular, oval, etc., and the locking pin hole 20 will have a corresponding configuration.

Figure 3:
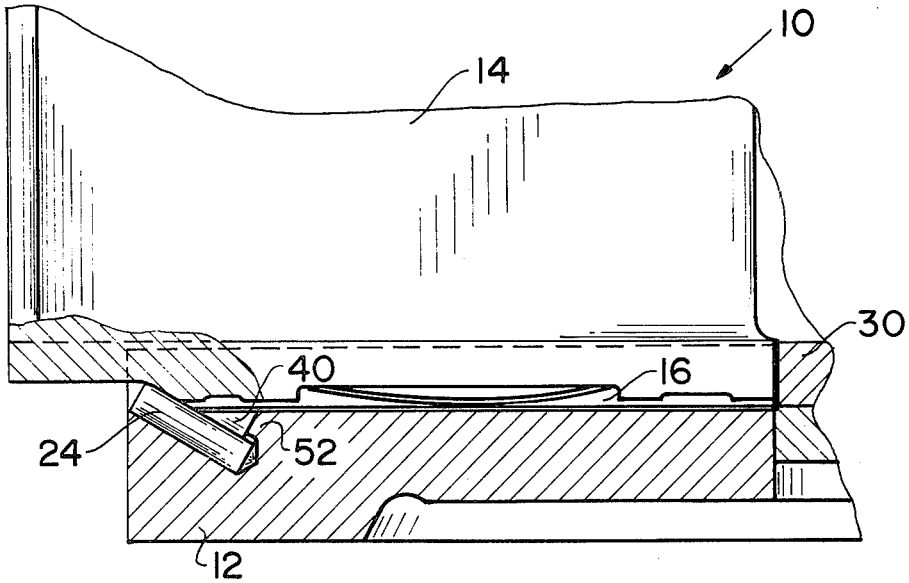
FIG. 3 is a view similar to FIG. 2 and shows a throwing vane and a locking pin in operative location.
Figure 5:
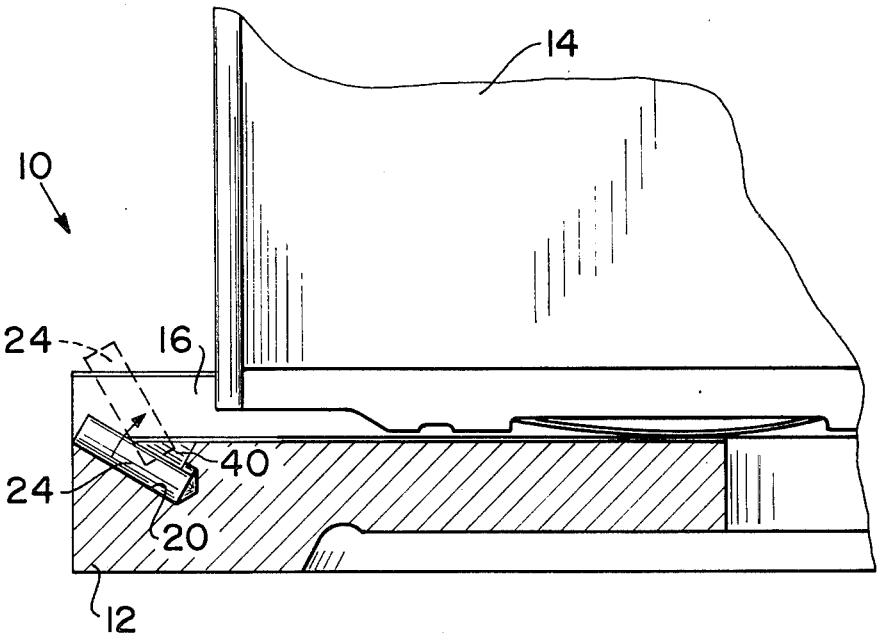
FIG. 5 is a fragmentary view, similar to FIG. 3, and illustrates the simplicity of removing the locking pin from the locking pin hole during replacement of the throwing vane.

It is well known that during assembly of the throwing wheel pin the throwing vanes 14 are moved radially inwardly of the runnerhead 12 past their normal operating location, such as is illustrated in FIG. 5, and the locking pin 24 is then located within the locking pin hole 20 and the throwing vane 14 is then moved radially outwardly until it contacts the locking pin 24 as is best shown in FIG. 3. A locking ring 30, as is best shown in FIGS. 1 and 3, is then fixed to the runnerhead 12 to lock the throwing vanes 14 against the locking pins 24. In this manner, the throwing vanes 14 are securely locked into operative position and are precluded from moving radially inwardly or outwardly of the vane receiving channel 16.

During maintenance procedures for replacing worn throwing vanes 14 the usual procedure is to remove the locking ring 30, move the throwing vane 14 radially inwardly, remove the locking pin 24, and slide the throwing vane 14 radially outwardly along the vane receiving channel 16. Thereafter, the steps are reversed by first sliding a new throwing vane 14 into the vane receiving channel 16, and so forth. The seemingly innocuous step of removing the locking pins of the prior art is not as simple as one might expect. Formerly, the locking pins 24 had to be removed axially because the locking pin 24 was seated in a cylindrical locking pin hole that had its outermost terminus flush with the plane of the vane receiving channel. During a typical life of a throwing vane 14, thousands of pounds, or even kilograms, of abrasive blasting particles will travel along the vane and it is not untypical that the abrasive particles or shot have an average particle size of 0.007 inch in diameter. It is essentially unavoidable that particles of this minute size become lodged in the hole occupied by the pin and wedged in between the pin and wall of the hole thereby making it difficult to remove the pin. It is a primary feature of the present invention to eliminate the possibility of the abrasive build up, but still retain a seat for the locking pin, by machining, or boring, or cutting away a portion of the wall of the conventional locking pin hole and providing a locking pin release channel 40 which allows the locking pin 24 to be leaned or tilted outwardly from the locking pin hole 20 as is best shown in FIG. 5 wherein the locking pin 24 is moved from the full line position to the dotted line position.

The locking pin release channel 40, as is best illustrated in FIGS. 1, 2 and 4, can be formed in various ways but, as an example and not as a limitation upon the invention, it is shown as being formed by a milling operation wherein, first, the locking pin hole 20 is drilled to extend angularly inwardly from the face 22, centrally located within the vane receiving channel 16, along an axial center line 42 (FIG. 2). After drilling of the locking pin hole 20 is completed, a milling tool (not shown) has its axis aligned parallel to the center line 42 and is moved perpendicular thereto until the milling tool cuts away a portion of the vane receiving channel 16 above the locking pin hole 20. The milling tool is of a larger diameter than the diameter of the locking pin hole 20 and is moved until the center line of the tool is approximately at the position indicated by the axial center line 44 in FIG. 2. As can be seen in FIGS. 1, 2 and 4, the locking pin release channel 40 is defined by side wall portions 46 and 48 and terminates at a tapered end wall 50 so as to provide an abbreviated shoulder 52 located adjacent an innermost portion of the locking pin hole 20 at a terminus of the locking pin release channel 40 thereby providing a seat for the locking pin 24.

The foregoing detailed description of a preferred embodiment of the invention is subjected to various modifications which will be obvious to those skilled in the art and it is to be understood that various changes and modifications may be made within the spirit and scope of the invention as defined by the following claimed subject matter.

I claim:

1. A runnerhead for a throwing wheel, said runnerhead comprising a plate member having a face and at least one vane receiving channel formed in said face for receiving a throwing vane, and locking means for locking said throwing vane in said vane receiving channel, said locking means including a locking pin hole for receiving a locking pin, said locking pin hole having an axis and being formed in said plate member and extending along said axis angularly inwardly from said face; the improvement comprising a locking pin release channel means formed in said plate member contiguous with said locking pine hole and spanning said locking pin hole for allowing a locking pin to be removed from said locking pin hole in a direction other than along said axis.

2. A runnerhead as defined in claim 1 wherein said locking pin hole is comprised of a cylindrical opening for receiving a cylindrical locking pin, said locking pin hole extending along a portion of the length of said vane receiving channel, and an abbreviated shoulder adjacent an innermost portion of said locking pin hole at a terminus of said locking pin release channel means for providing a seat for the locking pin.

3. A runnerhead as defined in claim 1 wherein said locking pin release channel means and said locking pin hole have respective axial center lines disposed parallel to and spaced from each other.

4. A runnerhead as defined in claim 1 wherein said locking pin release channel means is defined by side wall portions spaced a distance wider than said locking pin hole for allowing a locking pin to be tilted from said locking pin hole in a plane perpendicular to said vane receiving channel.

* * * * *